United States Patent [19]

Khulbe et al.

[11] 4,299,685

[45] Nov. 10, 1981

[54] HYDROCRACKING OF HEAVY OILS/FLY ASH SLURRIES

[76] Inventors: Chandra P. Khulbe, 700 Bathgate Dr., #195; Ramaswami Ranganathan, 309-210 Woodridge Crescent, both of Ottawa, Ontario; Barry B. Pruden, 32 Dalcastle Way, N.W., Calgary, Alberta, all of Canada

[21] Appl. No.: 126,891

[22] Filed: Mar. 3, 1980

[30] Foreign Application Priority Data

Mar. 5, 1979 [CA] Canada ..... 322744

[51] Int. Cl.[3] ..... C10G 9/16; C10G 47/12; C10G 47/22; C10G 47/26

[52] U.S. Cl. ..... 208/48 AA; 208/8 R; 208/10; 208/107; 208/108; 208/112; 208/216 R; 208/126; 252/467; 252/470

[58] Field of Search ..... 208/108, 8, 50, 54, 208/10, 48 R, 48 AA, 107–112

[56] References Cited

U.S. PATENT DOCUMENTS

| | | | |
|---|---|---|---|
| 3,151,057 | 9/1964 | Schuman et al. | 208/111 |
| 3,775,296 | 11/1973 | Chervenak et al. | 208/108 |
| 3,844,937 | 10/1974 | Wolk | 208/108 |
| 4,176,051 | 11/1979 | Ternan et al. | 208/112 |
| 4,214,977 | 7/1980 | Ranganathan et al. | 208/108 |
| 4,220,518 | 9/1980 | Uchida et al. | 208/48 R |

*Primary Examiner*—Delbert E. Gantz
*Assistant Examiner*—G. E. Schmitkons

[57] ABSTRACT

An improved process is described for the hydrocracking of heavy hydrocarbon oil, such as oils extracted from tar sands. The charge oil in the presence of an excess of hydrogen is passed through a tubular hydrocracking zone, and the effluent emerging from the top of the zone is separated into a gaseous stream containing a wide boiling range material and a liquid stream containing heavy hydrocarbons. According to the novel feature, the charge stock is in the form of a slurry of heavy hydrocarbon oil and finely divided fly ash or high ash coal fines. The presence of this ash in the charge stock serves to greatly reduce coke precursors and thereby prevent the formation of carbonaceous deposits in the reaction zone.

10 Claims, 1 Drawing Figure

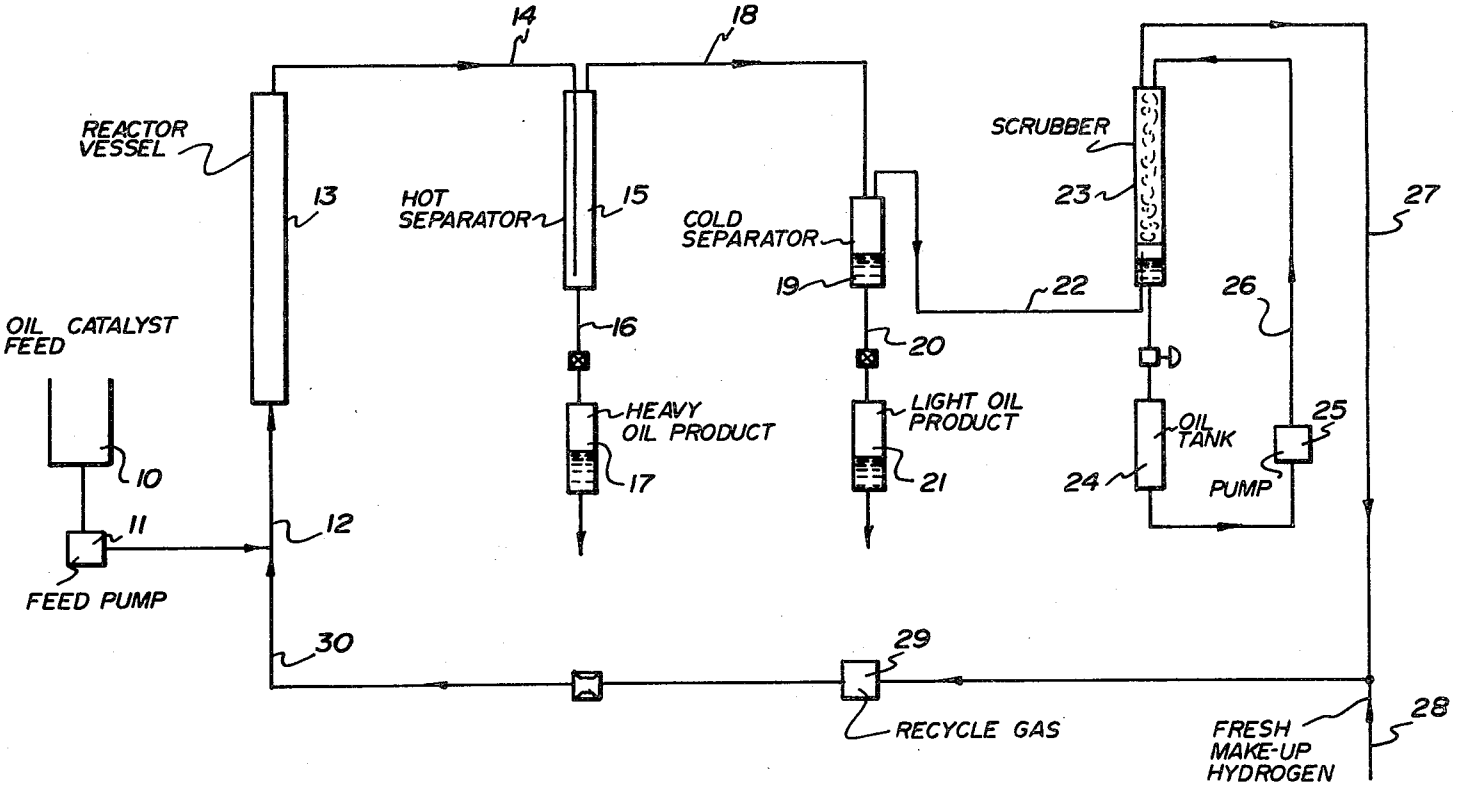
27
28
FRESH MAKE-UP HYDROGEN
25
PUMP
26
OIL TANK
SCRUBBER
23
22
24
LIGHT OIL PRODUCT
20
21
29
RECYCLE GAS
COLD SEPARATOR
19
18
HEAVY OIL PRODUCT
15
16
17
14
HOT SEPARATOR
13
12
30
REACTOR VESSEL
CATALYST
10
11
OIL FEED
FEED PUMP

HYDROCRACKING OF HEAVY OILS/FLY ASH SLURRIES

This invention relates to the treatment of hydrocarbon oils and, more particularly, to the hydrocracking of heavy hydrocarbon oils to produce improved products of lower boiling range.

Hydrocracking processes for the conversion of heavy hydrocarbon oils to light and intermediate naphthas of good quality for reforming feed stocks, fuel oil and gas oil are well known. These heavy hydrocarbon oils can be such materials as petroleum crude oil, atmospheric tar bottoms products, vacuum tar bottoms products, heavy cycle oils, shale oils, coal derived liquids, crude oil residuum, topped crude oils and the heavy bituminous oils extracted from oil sands. Of particular interest are the oils extracted from oil sands and which contain wide boiling range materials from naphthas through kerosene, gas oil, pitch, etc. and which contain a large portion of material boiling above 524° C.

The heavy hydrocarbon oils of the above type tend to contain nitrogenous and sulphurous compounds in exceedingly large quantities. In addition, such heavy hydrocarbon fractions frequently contain excessive quantities of organo-metallic contaminants which tend to be detrimental to various catalytic processes that may subsequently be carried out, such as hydrofining. Of the metallic contaminants, those containing nickel and vanadium are most common, although other metals are often present. These metallic contaminants, as well as others, are usually present within the bituminous material as organo-metallic compounds of relatively high molecular weight. A considerable quantity of the organo-metallic complexes are linked with asphaltenic material and contain sulphur. Of course, in catalytic hydrocracking procedures, the presence of large quantities of asphaltenic material and organic-metallic compounds interferes considerably with the activity of the catalyst with respect to the destructive removal of nitrogenous, sulphurous and oxygenated compounds. A typical Athabasca bitumen may contain 53.76 wt. % material boiling above 524° C., 4.74 wt. % sulphur, 0.59 wt. % nitrogen, 162 ppm vanadium and 72 ppm nickel.

As the reserves of conventional crude oils decline, these heavy oils must be upgraded to meet the demands. In this upgrading, the heavier material is converted to lighter fractions and most of the sulphur, nitrogen and metals must be removed. This can be done either by a coking process, such as delayed or fluidized coking, or by a hydrogen addition process, such as thermal or catalytic hydrocracking. The distillate yield from the coking process is about 70 wt. % and this process yields about 23 wt. % coke as a by-product which cannot all be used as fuel because of low H/C ratio, high mineral and sulphur content. This loss of coke represents an excessive waste of natural resources. Depending on operating conditions, hydrogenation processes can give a distillate yield of over 87 wt. %.

Recent work has been done on an alternate processing route involving hydrogen addition at high pressures and temperatures and this has been found to be quite promising. In this process, hydrogen and heavy oil are pumped upwardly through an empty tubular reaction in the absence of any catalyst. It has been found that the high molecular weight compounds hydrogenate and/or hydrocrack into lower boiling ranges. Simultaneous desulphurization, demetalization and denitrogenation reactions take place. Reaction pressures up to 3500 psig. and temperatures up to 470° C. have been employed.

In thermal hydrocracking, the major problem is coke or solid deposition in the reactor, especially when operating at relatively low pressures, and this can result in costly shut-downs. Deposits form at the top of the reactor where the partial pressure of hydrogen and the ash content are at the lowest. Higher pressures reduce reactor fouling. At 3500 psig. and 470° C., the coke deposition can be substantially eliminated. However, plant operations at high pressures involve higher capital and operating costs.

It has been well established that mineral matter present in the feed stock plays an important role in coke deposition. Chervenak et al U.S. Pat. No. 3,775,296 shows that feed stock containing high mineral content (1 wt. %) had less tendency to form coke in the reactor than feed containing low mineral matter (1 wt. %). Other studies have shown that a high mineral content had no apparent effect on pitch conversion and desulphurization, but suppressed coke deposition in the reactor and general reaction fouling.

It has also previously been shown that coke deposition in the reactor can be suppressed by recirculating a portion of heavy ends to the lower portion of the reaction zone. In Wolk, U.S. Pat. No. 3,844,937 it has been shown that when the mineral concentration of the reactor fluid was maintained between 4 and 10 wt. % during thermal hydrocracking, no coke was found in the reactor. It seemed that during the hydrocracking process, carbonaceous material deposited on solid particles instead of the reactor wall, and could thus be carried out with the reactor effluent. This indicated the possibility of continuously adding and withdrawing a coke carrier in the reactor. The addition of coke carriers was proposed in Schuman et al. U.S. Pat. No. 3,151,057, who suggested the use of "getters" such as sand, quartz, alumina, magnesia, zircon, beryl or bauxite. These "getters" could be regenerated after use by heating the fouled carrier with oxygen and steam at about 1090° C. to yield regeneration-product-gases containing a substantial amount of hydrogen. Schuman et al U.S. Pat. No. 3,151,057 shows that heavy oil can be hydrogenated by adding clay or bauxite in the feed and by recycling the liquid from the upper part of the reaction zone to the lower part of the reaction zone at a rate of at least 5:1 based on feed. The use of coal as a "getter" has been described in Ternan et al copending Canadian application Ser. No. 269,020 filed Dec. 30, 1976, now Canadian Pat. No. 1,073,389, issued Mar. 11, 1980, and it was observed that coal particles were able to accumulate metals and any coke formed during the hydrocracking process.

It is the object of the present invention to overcome the problem of deposits forming in the reactor during the hydrocracking process, while minimizing the costs of overcoming these problems.

SUMMARY OF THE INVENTION

In accordance with the present invention, there is described a process for hydrocracking a heavy hydrocarbon oil, a substantial portion of which boils above 524° C. which comprises:

(a) passing a slurry of said heavy hydrocarbon oil and finely divided fly ash or high ash coal fines in the presence of 500–50,000 scf of hydrogen per barrel of said hydrocarbon oil through a confined hydrocracking zone, said hydrocracking zone being maintained at a temperature between about 400° and 500° C., a pressure of at least 500 psig and a space velocity between about 0.5 and 4 volume of hydrocarbon oil per hour per volume of hydrocracking zone capacity, (b) removing from said hydrocracking zone a mixed effluent containing a gaseous phase comprising hydrogen and vaporous hydrocarbons and a liquid phase comprising heavy hydrocarbons, and (c) separating said effluent into a gaseous stream containing hydrogen and vaporous hydrocarbons and a liquid stream containing heavy hydrocarbons.

This process substantially prevents the formation of carbonaceous deposits in the reaction zone. These deposits, which may contain insoluble organic material, mineral matter, metals, sulphur, quinoline and benzene soluble organic material will hereinafter be referred to as "solids" or "coke" deposits.

The process of this invention is particularly well suited for the treatment of heavy oils having a large proportion, preferably at least 50% by volume, which boils about 524° C. and which contains a wide boiling range of materials from naphtha through kerosene, gas oil and pitch. It can be operated at quite moderate pressure, preferably in the range of 500 to 3500 psig., without coke formation in the hydrocracking zone.

Although the hydrocracking can be carried out in a variety of known reactors of either up or down flow, it is particularly well suited to a tubular reactor through which it is moved upwardly. The effluent from the top is preferably separated in a hot separator and the gaseous stream from the hot separator can be fed to a low temperature-high pressure separator where it is separated into a gaseous stream containing hydrogen and lesser amounts of gaseous hydrocarbons and a liquid product stream containing light oil product.

Any type of fly ash or high ash coal fines (referred to hereinafter generally as "fly ash") can be used. A large proportion of the fly ash is usually quite small in particle size, e.g. less than 100 mesh (Canadian Standard Sieve). The fly ash concentration in the feed is normally between about 0.1–5.0 weight percent, preferably about 1.0 weight percent. For high pitch conversion of desulphurization, the fly ash can be coated with catalytic material such as iron, tungsten, cobalt, molybdenum and other catalytically active metals. The metal loading will depend on the cost of the material, and optimum catalyst activity. The catalyst can be coated on fly ash by spraying aqueous solutions of metal salt. The fly ash can then be dried to reduce the moisture content before blending with the feed stock. The mixing of fly ash with the bitumen or heavy oil should be done carefully to prevent any formation of lumps.

Fly ash is a well known material and is the by-product from the combustion of pulverized coal or petroleum coke, in thermal power plants. It is removed by mechanical collectors or electrostatic precipitators as a fine particulate residue from the combustion gases before they are discharged to the atmosphere.

According to a preferred embodiment, the heavy hydrocarbon oil feed and fly ash are mixed in a feed tank and pumped along with hydrogen through a vertical reactor. The liquid-gas mixture from the top of the hydrocracking zone is separated in a hot separator kept between 250° C. and the reactor temperature and at the pressure of the hydrocracking reaction. The heavy hydrocarbon oil product from the hot separator can either be recycled or sent to secondary treatment.

The gaseous stream from the hot separator containing a mixture of hydrocarbon gases and hydrogen is further cooled and separated in a low temperature-high pressure separator. By using this type of separator, the outlet gaseous stream obtained contains mostly hydrogen with some impurities such as hydrogen sulphide and light hydrocarbon gases. This gaseous stream is passed through a scrubber, and the scrubbed hydrogen is recycled as part of the hydrogen feed to the hydrocracking process. The recycled hydrogen gas purity is maintained by adjusting scrubbing conditions and by adding make up hydrogen.

The liquid stream from the low temperature-high pressure separator represents the light hydrocarbon oil product of the present process and can be sent for secondary treatment.

The fly ash is carried over with the heavy oil product from the hot separator and is found in the 524° C.+pitch fraction. The fly ash which has been carried over can be concentrated, e.g. in a cyclone separator, and recycled back to the reactor. Alternatively, since this is a very cheap material, it need not be recovered and can be burned or gasified with the pitch. At the start of the process, there tends to be some accumulation of fly ash in the reactor system but this stabilizes after a few days of operation.

The mineral matter in fly ash acts as catalyst in suppressing coke forming reactions. It has a slightly negative effect on hydrocracking and desulphurization. However, the comparison of fly ash processes with other processes clearly shows that coke deposits can be completely eliminated and coke precursors significantly reduced.

For a better understanding of the invention, reference is made to the accompanying drawing which illustrates diagrammatically a preferred embodiment of the present invention.

Heavy hydrocarbon oil feed and fly ash are mixed together in a feed tank 10 to form a slurry. This slurry is pumped via feed pump 11 through inlet line 12 into the bottom of an empty tower 13. Recycled hydrogen and make up hydrogen from line 30 is simultaneously fed into the tower 13 through line 12. A gas-liquid mixture is withdrawn from the top of the tower through line 14 and introduced into a hot separator 15. In the hot separator the effluent from tower 13 is separated into a gaseous stream 18 and a liquid stream 16. The liquid stream 16 is in the form of heavy oil which is collected in vessel 17 and contains carried over fly ash or high ash coal fines solids.

According to an alternative feature, a branch line is connected to line 16. This branch line connects through a pump into inlet line 12, and serves as a recycle for recycling the liquid stream containing carried over fly ash or high ash fines from hot separator 15 back into the feed slurry to tower 13.

In yet another embodiment, the line 16 feeds into a cyclone separator which separates the fly ash or high ash coal fines from the liquid stream. The separated fly ash or high ash coal fines are recycled into the feed slurry to tower 13, while the remaining liquid is collected in vessel 17.

The gaseous stream from hot separator 15 is carried by way of line 18 into a high pressure-low temperature separator 19. Within this separator the product is separated into a gaseous stream rich in hydrogen which is drawn off through line 22 and an oil product which is drawn off through line 20 and collected at 21.

The hydrogen rich stream 22 is passed through a packed scrubbing tower 23 where it is scrubbed by means of a scrubbing liquid 24 which is cycled through the tower by means of pump 25 and recycle loop 26. The scrubbed hydrogen rich stream emerges from the scrubber via line 27 and is combined with fresh make up hydrogen added through line 28 and recycled through recycle gas pump 29 and line 30 back to tower 13.

Certain preferred embodiments of this invention will now be further illustrated by the following non-limitative examples.

For the following examples fly ash was obtained from two different sources. One sample was obtained from The Great Canadian Oil Sands tar sands mining complex utilizing the hot water (separation) and delayed coking (upgrading) processes. This sample resulted from the burning of a base load of the residual coke from the delayed cokers plus a fluctuating load of fuel oil. The second sample was obtained from the Saskatchewan Power Corp., Saskatchewan (SPC) from burning Saskatchewan lignite. Typical screen analysis and chemical analysis of these samples are given in Tables 1 and 2 below.

TABLE 1

SCREEN ANALYSIS OF FLY ASH SAMPLES*

| Retained on Screen Size | GCOS Fly Ash Wt. % | SPC Fly Ash Wt. % |
|---|---|---|
| +100 | 5.50 | 4.80 |
| −100 to +140 | 11.60 | 7.00 |
| −140 to +200 | 32.50 | 24.90 |
| −200 to +325 | 24.80 | 30.60 |
| −325 to +400 | 10.80 | 8.00 |
| −400 to +0 | 14.80 | 24.70 |

*Sonic sieve, run time 10 min.

TABLE 2

PROPERTIES OF FLY ASH SAMPLES

| | | GCOS Fly Ash | SPC Fly Ash |
|---|---|---|---|
| $SiO_2$ | wt. % | 31.35 | 49.04 |
| $Al_2O_3$ | wt. % | 17.08 | 19.79 |
| $Fe_2O_3$ | wt. % | 5.35 | 4.17 |
| $MnO_2$ | wt. % | 0.08 | — |
| $TiO_2$ | wt. % | 5.80 | 1.37 |
| $P_2O_5$ | wt. % | 0.14 | 0.45 |
| CaO | wt. % | 1.02 | 12.37 |
| MgO | wt. % | 0.89 | 1.81 |
| $SO_3$ | wt. % | 0.78 | 0.71 |
| $Na_2O$ | wt. % | 0.37 | 5.43 |
| $K_2O$ | wt. % | 1.25 | 0.65 |
| NiO | wt. % | 0.92 | 0.04 |
| $V_2O_5$ | wt. % | 3.08 | — |
| $MoO_3$ | wt. % | 0.07 | — |
| Loss on ignition | wt. % | 31.82 | 4.09 |
| ZnO | wt. % | — | 0.06 |

TABLE 2-continued

PROPERTIES OF FLY ASH SAMPLES

| | | GCOS Fly Ash | SPC Fly Ash |
|---|---|---|---|
| CuO | wt. % | — | 0.02 |

EXAMPLE 1

A series of batch tests were conducted to determine coking tendencies. These tests were conducted using a bitumen feed stock having the properties shown in Table 3 below:

TABLE 3

PROPERTIES OF BITUMEN FEEDSTOCK

| | | |
|---|---|---|
| Specific gravity | 15/15° C. | 1.013 |
| Sulphur | wt. % | 4.74 |
| Nitrogen | wt. % | 0.59 |
| Ash | wt. % | 0.59 |
| Viscosity at 99° C. | cst | 213 |
| Conradson Carbon Residue | wt. % | 14.9 |
| Pentane insolubles | wt. % | 16.8 |
| Benzene insolubles | wt. % | 0.52 |
| Nickel | ppm (wt) | 72 |
| Vanadium | ppm (wt) | 162 |
| Pitch content | wt. % | 53.76 |
| Sulphur in 524° C.$^-$ dist. | wt. % | 2.96 |
| Sulphur in 524° C.$^+$ pitch | wt. % | 6.18 |

The concentration of benzene insoluble organic residue (BIOR) in the total liquid product or in pitch is an indication of coking tendency. Thus, higher BIOR concentration indicates higher coking tendency.

The experiments were conducted in a 2 liter stirred autoclave (batch operation) at a temperature of 450° C. and operating pressure of 1500 psi. About 500 grams of the bitumen feed stock was mixed with an amount of additive selected from Whitewood coal, alumina and SPC fly ash. This was added to the reactor and thoroughly mixed. Before heating the reactor, hydrogen pressure was maintained at 400 psi and the reactor was then heated to 450° C. in 4 hours, with a stirrer operating at 1500 rpm. As soon as the reaction temperature was reached, the operating pressure was increased to 1500 psi by adding more hydrogen. At these conditions temperature was maintained for 1 hour after which the reactor was allowed to cool to room temperature in about 6 hours. At room temperature the reactor was opened and samples were collected and analyzed.

The operating conditions and results obtained for the above tests are shown in Table 4 below:

TABLE 4

BATCH OPERATION STUDIES
Comparison of Additives for Hydrocracking

| Additive Type | Additive Wt. g. | Feed g. | Pressure psi | Temperature °C. | Heating Time h | Run Time h | Cooling Time h | BIOR Produced Wt. % of feed |
|---|---|---|---|---|---|---|---|---|
| Nil | — | 615.5 | 1500 | 450 | 4 | 1 | 6 | 17.65 |
| Whitewood coal | 8.5 | 575.1 | 1500 | 450 | 4 | 1 | 6 | 17.10 |
| Alumina | 1.5 | 612.2 | 1500 | 450 | 4 | 1 | 6 | 19.79 |
| SPC Fly Ash | 10.0 | 534.8 | 1500 | 450 | 4 | 1 | 6 | 15.17 |

The above experiments indicate that fly ash will be an excellent additive to reduce solid deposition in thermal hydrocracking processes.

EXAMPLE 2

A feed slurry was prepared consisting of the bitumen feed stock of Table 3 containing 1 wt. % of the fly ash described in Tables 1 and 2. This thoroughly mixed feed slurry was then hydrocracked in a one barrel per day pilot plant of the type shown in the attached drawing.

At the same conditions, runs were conducted with other additives such as coal and $FeSO_4$-coal and without the use of any additive (thermal run). The pilot plant was opened after each run and inspected for solid deposition.

The operating conditions and results for different runs are given in Tables 5 and 6 below.

TABLE 5

OPERATING CONDITIONS FOR HYDROCRACKING

| | Case 1 | Case 2 | Case 3 | Case 4 |
|---|---|---|---|---|
| Additive | Nil | w.w coal | $FeSO_4$—ww coal | Fly Ash GCOS |
| Amount of wt.% additive | — | 2 | 1 | 1 |
| Pressure psig. | 1500 | 1500 | 1500 | 1500 |
| Reactor Temp. °C. (Length of run) | 450 (384h) | 450 (504h) | 450 (58h) 455 (454h) | 450 (140h) |
| LHSV | 3.0 | 3.0 | 3.0 | 3.0 |
| Hydrogen cf/h at Gas Rate pressure | 2.0 | 2.0 | 2.0 | 2.0 |
| Hot Receiver °C. Temp. | 370 | 370 | 370 | 350 |
| Cold Receiver °C. Temp. | 23 | 23 | 23 | 23 |
| $H_2$ Concentration vol. % (recycle gas) | 85 | 85 | 85 | 85 |

TABLE 6

COMPARISON OF HYDROCRACKING RESULTS

| | | Case 1 | Case 2 | Case 3 | Case 4 |
|---|---|---|---|---|---|
| Pitch Conversion | wt. % | 60.6 | 58.1 | 58.9 | 51.7 |
| Sulphur Conversion | wt. % | 29.9 | 32.44 | 36.3 | 31.5 |
| $H_2$ Consumed | g-mol/kg | 2.6 | 3.36 | 3.8 | 2.66 |
| Product Volume Yield | vol. % | 100.0 | 98.8 | 100.1 | 101.2 |
| Product Weight Yield | wt. % | 94.2 | 94.2 | 94.8 | 96.9 |
| Product Gravity | 15/15° C. | 0.954 | 0.961 | 0.953 | 0.970 |
| Sulphur in Product | wt. % | 3.33 | 3.12 | 3.01 | 3.35 |
| Total Solid Deposited in the system | g. | 6600 | 132.1 | 10 | — |

Case 1 represents a run without any additive and this run was conducted for 384 hours, at the end of which the reactor was full of solids. Case 2 represents a run using 2 wt. % coal mixed with the bitumen feed stock. This run was conducted at conditions similar to that for the base run. After operating the plant for 504 hours there were 132 grams of solids in the reactor when it was opened.

Case 3 represents a run at base conditions, a $FeSO_4$ coal catalyst at 1 wt. % of feed. This run was conducted for 58 hours at 450° C. and 444 hours at 455° C. On the completion of the run there were less than 10 grams of solids in the reactor. At 455° C. the pilot plant could not be operated more than a few hours in the absence of any additive as the reactor inlet, outlet and transfer lines were completely plugged.

Case 4 represents a run at base conditions but using 1 wt. % GCOS fly ash and bitumen in the form of a slurry. During operation, the total system pressure drop was low and steady. The reactor skin temperature and other external indications showed no signs of solid deposition in the reactor for 140 hours. At these conditions, the solid deposition in the reactor should have been less than 10 grams. Hence, after 140 hours of operation the temperature of the reactor was slowly increased to 465° C.

EXAMPLE 3

Operating conditions and results for three runs are given in Tables 7 and 8 below:

TABLE 7

OPERATING CONDITIONS FOR HYDROCRACKING

| | Case 5 | Case 6 | Case 7 |
|---|---|---|---|
| Additive | Nil | $FeSO_4$—ww coal | GCOS Fly Ash |
| Amount of additive Wt. % (Length of run) | — | 2(121 h) 1(333 h) | 1 |
| Pressure psig | 1500 | 1500 | 1500 |
| Reactor Temp. °C. | 465 | 465 | 465 |
| LHSV | 3.0 | 3.0 | 3.0 |
| $H_2$ Gas Rate cf/h at 15° C. and pressure reactor | 2.0 | 2.0 | 2.0 |
| Hot Receiver °C. temp. | 370 | 370 | 370 |
| Cold Receiver °C. temp. | 23 | 23 | 23 |
| Hydrogen Conc. vol. % (recycle gas) | 85 | 85 | 85 |

TABLE 8

COMPARISON OF RESULTS FOR ADDITIVES

| | | Case 5 | Case 6 | Case 7 |
|---|---|---|---|---|
| Additive | | Nil | $FeSO_4$—ww coal | GCOS Fly Ash |
| Pitch Conversion | wt. % | At these conditions without any additive | 73.2 | 70.0 |
| Sulphur Conversion | wt. % | | 36.41 | 41.31 |
| $H_2$ Consumed | g-mol/kg | | 4.32 | 4.03 |
| Product Volume Yield | vol. % | plant cannot be operated for more than a few hours. | 101.3 | 102.8 |
| Product Weight Yield | wt. % | | 93.7 | 96.6 |
| Product Gravity | 15/15° C. | | .932 | 0.952 |
| Sulphur in Product | wt. % | | 3.04 | 2.88 |
| Total Solids Deposited in the system | g. | | 51.8 | 10.3 |

Case 5 represents a run without any additive. At these conditions, pitch conversion would have been about 75 wt. %. The correlation between BIOR and pitch conversion indicates that at about 75 wt. % pitch conversion, a maximum amount of BIOR is produced. A run without additive at 450° C. yielded 6600 g. of solids after 384 hours of operation.

Using no catalyst, the plant could not be operated for more than a few hours at 455° C. Hence, at conditions of case 5, it was impossible to operate the plant.

Case 6 represents a run at the conditions of case 5 but using a $FeSO_4$-coal catalyst. After 454 hours of operation there were 51.8 grams of solids deposited in the reactor.

Case 7 represents a run at conditions of case 5 but using GCOS Fly Ash to reduce solid deposition. The plant was operated for a total of 490 hours and during the operation pressure drop was low and steady. After the completion of the run only 103 grams of solids were deposited in the reactor, which is an insignificant amount and indicates that when using fly ash, the hydrocracking plant can be operated for longer periods of time without reactor fouling.

The above examples are given at high liquid hourly space velocity and temperature, resulting in a high temperature severity for a given pitch conversion. This temperature severity can be decreased by decreasing the liquid hourly space velocity and temperature to give the same pitch conversion and under those conditions the amount of coke deposition will be reduced accordingly.

The embodiments of the invention in which an exclusive property or privilege are claimed are defined as follows:

1. A process for hydrocracking a heavy hydrocarbon oil, a substantial proportion of which boils above 524° C. which comprises:

(a) passing a slurry of said heavy hydrocarbon oil and finely divided fly ash or high ash coal fines in the presence of 500–50,000 scf of hydrogen per barrel of said hydrocarbon oil through a confined hydrocracking zone, said hydrocracking zone being maintained at a temperature between about 400° and 500° C., a pressure above 500 psig. and a space velocity between about 0.5 and 4.0 volumes of heavy hydrocarbon oil per hour per volume of hydrocracking zone capacity, (b) removing from said hydrocracking zone a mixed effluent containing a gaseous phase comprising hydrogen and vaporous hydrocarbons and a liquid phase comprising heavy hydrocarbons, and (c) separating said effluent into a gaseous stream containing hydrogen and vaporous hydrocarbons and a liquid stream containing heavy hydrocarbons.

2. A process according to claim 1 wherein the slurry is moved upwardly through a tubular reactor.

3. A process according to claim 2 wherein the slurry is moved upwardly through a vertical empty column reactor.

4. A process according to claim 1 wherein the fly ash or high ash coal fines is present in an amount of 0.01–5 wt. % based on heavy hydrocarbon oil charge stock.

5. A process according to claim 4 wherein the fly ash or high ash coal fines is coated with a catalytically active metal.

6. A process according to claim 1, 4 or 5, wherein a large proportion of the fly ash or high ash coal fines has a particle size of less than 100 mesh.

7. A process according to claim 5 wherein the metal is selected from iron, tungsten, cobalt and molybdenum.

8. A process according to claim 1 wherein the separated liquid stream containing heavy hydrocarbons is recycled back into the confined hydrocracking zone.

9. A process according to claim 1 wherein fly ash or high ash coal fines carried over with the separated liquid stream containing heavy hydrocarbons are concentrated and recycled to the confined hydrocracking zone.

10. A process according to claim 9 wherein the concentrating is carried out by means of a cyclone separator.

* * * * *